US008443915B2

(12) United States Patent
Storm, Jr. et al.

(10) Patent No.: US 8,443,915 B2
(45) Date of Patent: May 21, 2013

(54) THROUGH DRILLSTRING LOGGING SYSTEMS AND METHODS

(75) Inventors: Bruce H. Storm, Jr., Houston, TX (US); James G. Aivalis, Katy, TX (US); Bulent Finci, Sugar Land, TX (US); Peter Wells, Houston, TX (US); Akio Kita, Katy, TX (US); Eric Johnson, Sugar Land, TX (US); Jonathan Macrae, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 182 days.

(21) Appl. No.: 12/582,520

(22) Filed: Oct. 20, 2009

(65) Prior Publication Data

US 2010/0096187 A1 Apr. 22, 2010

Related U.S. Application Data

(63) Continuation-in-part of application No. 11/680,461, filed on Sep. 11, 2007, now Pat. No. 7,708,057.

(60) Provisional application No. 60/844,604, filed on Sep. 14, 2006.

(51) Int. Cl.
*E21B 47/01* (2012.01)

(52) U.S. Cl.
USPC ..... 175/40; 175/57

(58) Field of Classification Search
USPC ..... 175/40, 50, 57
See application file for complete search history.

(56) References Cited

U.S. PATENT DOCUMENTS

| | | | | |
|---|---|---|---|---|
| 3,117,636 | A * | 1/1964 | Wilcox et al. | 175/257 |
| 5,950,742 | A | 9/1999 | Caraway | |
| 6,035,953 | A | 3/2000 | Rear | |
| 6,062,326 | A | 5/2000 | Strong et al. | |
| 6,119,777 | A | 9/2000 | Runia | |
| 6,181,132 | B1 | 1/2001 | Runia | |
| 6,269,891 | B1 | 8/2001 | Runia | |
| 6,702,041 | B2 | 3/2004 | Runia | |
| 6,799,634 | B2 | 10/2004 | Hartog et al. | |
| 7,059,410 | B2 | 6/2006 | Bousche et al. | |
| 7,134,493 | B2 | 11/2006 | Runia | |
| 7,140,454 | B2 | 11/2006 | Runia | |
| 7,188,672 | B2 | 3/2007 | Berkheimer et al. | |
| 7,207,398 | B2 | 4/2007 | Runia et al. | |
| 7,215,125 | B2 | 5/2007 | Clark | |
| 7,281,592 | B2 | 10/2007 | Runia et al. | |

(Continued)

OTHER PUBLICATIONS

International Search Report and Written Opinion dated Jun. 24, 2011, International Application No. PCT/US2010/053376.

(Continued)

*Primary Examiner* — Brad Harcourt
(74) *Attorney, Agent, or Firm* — Chamberlain Hrdlicka

(57) ABSTRACT

Embodiments of the present invention generally relate to methods and systems for logging through a drillstring. In one embodiment, a method of logging an exposed formation includes drilling a wellbore by rotating a cutting tool disposed on an end of a drillstring and injecting drilling fluid through the drillstring; deploying a BHA through the drillstring, the BHA including a logging tool; forming a bore through the cutting tool; inserting the logging tool through the bore; longitudinally connecting the BHA to the drillstring; and logging the exposed formation using the logging tool while tripping the drillstring into or from the wellbore.

36 Claims, 11 Drawing Sheets

U.S. PATENT DOCUMENTS

| | | | | |
|---|---|---|---|---|
| 7,287,609 | B2 | 10/2007 | Runia et al. | |
| 7,296,639 | B2 | 11/2007 | Millar et al. | |
| 7,367,410 | B2 | 5/2008 | Sangesland | |
| 7,395,882 | B2 | 7/2008 | Oldham et al. | |
| 7,537,061 | B2 | 5/2009 | Hall et al. | |
| 7,549,471 | B2 | 6/2009 | Aivalis et al. | |
| 7,708,057 | B2 | 5/2010 | Aivalis et al. | |
| 7,748,466 | B2 | 7/2010 | Aivalis et al. | |
| 2001/0035289 | A1 | 11/2001 | Runia | |
| 2004/0074639 | A1* | 4/2004 | Runia | 166/254.2 |
| 2006/0118298 | A1* | 6/2006 | Millar et al. | 166/242.7 |
| 2006/0185906 | A1* | 8/2006 | Vail | 175/324 |
| 2006/0266512 | A1 | 11/2006 | Lohbeck | |
| 2008/0029312 | A1* | 2/2008 | Hall et al. | 175/429 |
| 2008/0173481 | A1* | 7/2008 | Menezes et al. | 175/40 |
| 2008/0173581 | A1 | 7/2008 | Maclean | |
| 2009/0038391 | A1 | 2/2009 | Aivalis et al. | |
| 2010/0096187 | A1 | 4/2010 | Storm et al. | |
| 2010/0108391 | A1 | 5/2010 | Runia | |

OTHER PUBLICATIONS

Runia et al.—"Through Bit logging: Applications in Difficult Wells, Offshore North Sea", SPE/IADC Drilling Conference 2005, held Feb. 23-25, 2005 in Amsterdam, The Netherlands, Richardson, Texas: Society of Petroleum Engineers, No. 92256, Feb. 23, 2005, pp. 1-8, XP-002571502.

Runia J. et al.—"Through Bit Logging: A New Method to Acquire Log Data", Petrophysics, Society of Professional Well Log Analysts, Houston, Texas, vol. 46, No. 4, Aug. 1, 2005, pp. 289-294, XP-002571503.

* cited by examiner

THROUGH DRILLSTRING LOGGING SYSTEMS AND METHODS

CROSS-REFERENCE TO RELATED APPLICATIONS

This application is a continuation-in-part of U.S. patent application Ser. No. 11/680,461, filed Sep. 11, 2007 now U.S. Pat. No. 7,708,057, which claims priority of U.S. Prov. App. No. 60/844,604 filed on Sep. 14, 2006. Both applications are herein incorporated by reference in their entireties.

BACKGROUND OF THE INVENTION

1. Field of the Invention

Embodiments of the present invention generally relate to methods and systems for logging through a drillstring.

2. Description of the Related Art

Wellbores are conventionally drilled using a drillstring to access hydrocarbon bearing formations, such as crude oil and/or natural gas. The drillstring generally includes a series of drillpipe threaded together and a bottomhole assembly (BHA). The BHA includes at least a drill bit and may further include components that turn the drill bit at the bottom of the wellbore. Oftentimes, the BHA includes a bit sub, a mud motor, and drill collars. The BHA may also include measurement-while-drilling (MWD)/logging-while-drilling (LWD) tools and other specialized equipment that would enable directional drilling. In conventional drilling, casings are typically installed in the wellbore to prevent the wellbore from caving in or to prevent fluid and pressure from invading the wellbore. The first casing installed is known as the surface casing. This surface casing is followed by one or more intermediate casings and finally by production casing. The diameter of each successive casing installed into the wellbore is smaller than the diameter of the previous casing installed into the wellbore. The drillstring is lowered into the wellbore to drill a new section of the wellbore and then tripped out of the wellbore to allow the casing to be installed in the wellbore.

Formation evaluation logs contain data related to one or more properties of a formation as a function of depth. Many types of formation evaluation logs, e.g., resistivity, acoustic, and nuclear, are recorded by appropriate downhole instruments placed in a housing called a sonde. A logging tool including a sonde and associated electronics to operate the instruments in the sonde is lowered into a wellbore penetrating the formation to measure properties of the formation. To reduce logging time, it is common to include a combination of logging devices in a single logging run. Formation evaluation logs can be recorded while drilling or after drilling a section of the wellbore. Formation evaluation logs can be obtained from an open hole (i.e., an uncased portion of the wellbore) or from a cased hole (i.e., a portion of the wellbore that has had metal casing placed and cemented to protect the open hole from fluids, pressure, wellbore stability problems, or a combination thereof). Formation evaluation logs obtained from cased holes are generally less accurate than formation evaluation logs obtained from open holes but they may be sufficient in some applications, such as in fields where the reservoir is well known.

Traditionally, open hole formation evaluation logs have been obtained using wireline logging. In wireline logging, the formation properties are measured after a section of a wellbore is drilled but before a casing is run to that section of the wellbore. The operation involves lowering a logging tool to total depth of the wellbore using a wireline (armored electrical cable) wound on a winch drum and then pulling the logging tool out of the wellbore. The logging tool measures formation properties as it is pulled out of the wellbore. The wireline transmits the acquired data to the surface. The length of the wireline in the wellbore provides a direct measure of the depth of the logging tool in the wellbore. Wireline logging can provide high quality, high density data quickly and efficiently, but there are situations where wireline logging may be difficult or impossible to run. For example, in highly deviated or horizontal wellbores, gravity is frequently insufficient to allow lowering of the logging tool to total depth by simply unwinding the wireline from the winch drum. In this case, it is necessary to push the logging tool along the well using, for example, a drill pipe, coiled tubing, or the like. This process is difficult, time consuming, and expensive. Another situation where wireline logging may be difficult and risky is in a wellbore with stability problems. In this case, it is usually desirable to immediately run casing to protect the open hole.

LWD is a newer technique than wireline logging. It is used to measure formation properties during drilling of a section of a wellbore, or shortly thereafter. An LWD tool includes logging devices installed in drill collars. The drill collars are integrated into the BHA of the drillstring. During drilling using the drillstring, the logging devices make the formation measurements. The LWD tool records the acquired data in its memory. The recorded data is retrieved when drilling stops and the drillstring is tripped to the surface. While LWD techniques allow more contemporaneous formation measurements, drilling operations create an environment that is generally hostile to electronic instrumentation and sensor operations.

SUMMARY OF THE INVENTION

Embodiments of the present invention generally relate to methods and systems for logging through a drillstring. In one embodiment, a method of logging an exposed formation includes: drilling a wellbore by rotating a cutting tool disposed on an end of a drillstring and injecting drilling fluid through the drillstring; deploying a BHA through the drillstring, the BHA including a logging tool; forming a bore through the cutting tool; inserting the logging tool through the bore; longitudinally connecting the BHA to the drillstring; and logging the exposed formation using the logging tool while tripping the drillstring into or from the wellbore.

In another embodiment, a method of logging an exposed formation includes: drilling a wellbore by rotating a cutting tool disposed on an end of a drillstring and injecting drilling fluid through the drillstring; deploying a BHA through the drillstring, the BHA including a logging tool; engaging a nose of the cutting tool with the BHA; removing the nose from a body of the cutting tool, thereby opening a bore through the cutting tool; inserting the logging tool through the bore; and logging the exposed formation using the logging tool.

In another embodiment, a method of logging an exposed formation includes: drilling a wellbore by rotating a cutting tool disposed on an end of a drillstring and injecting drilling fluid through the drillstring; operating a tractor, thereby deploying a BHA through the drillstring. The BHA includes a logging tool and the tractor. The tractor is operated by relative rotation between the tractor and the drillstring. The method further includes forming or opening a bore through the cutting tool; inserting the logging tool through the bore; and logging the exposed formation using the logging tool.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
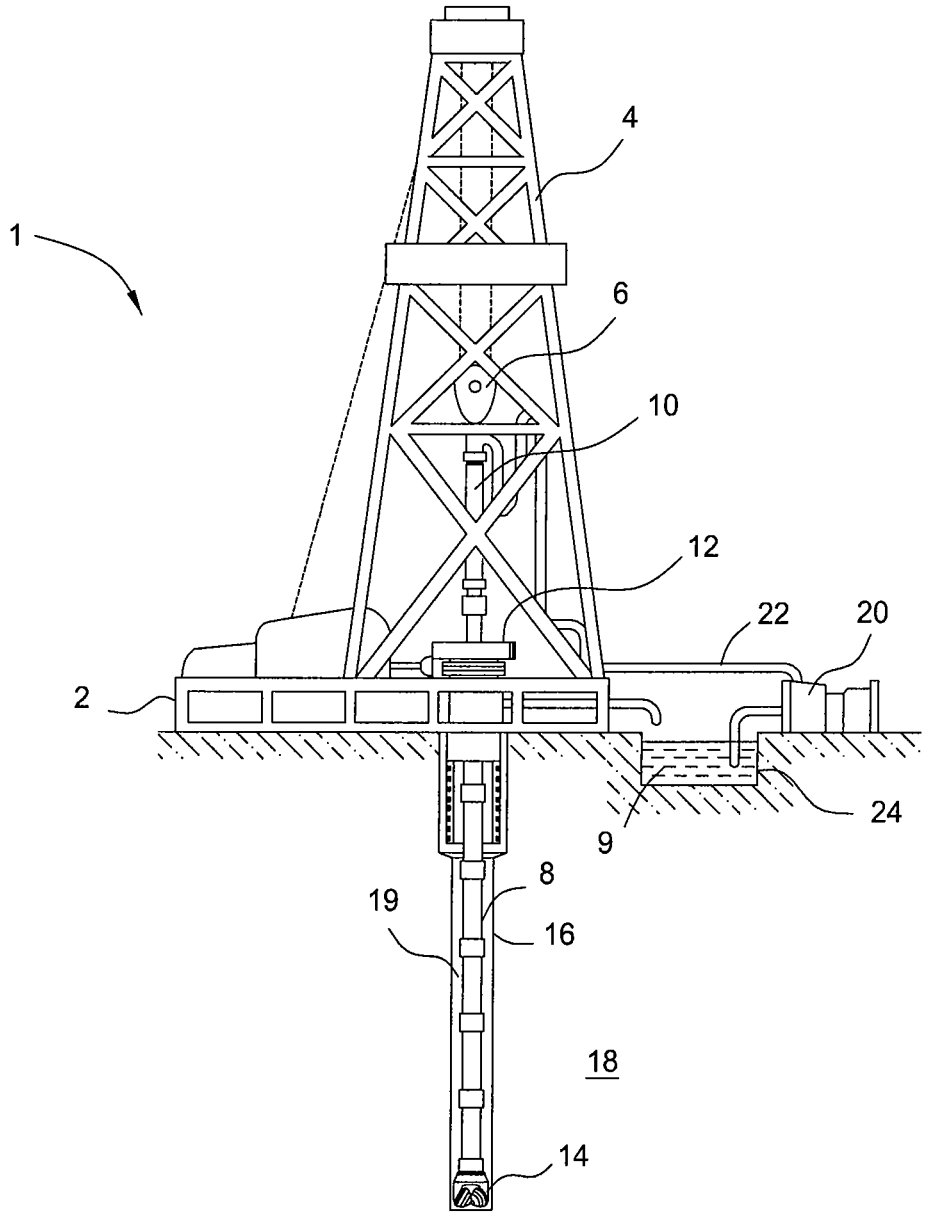
FIGS. 1 and 1A-1C illustrate a logging operation conducted through the drillstring, according to one embodiment of the present invention.
Figure 1B:
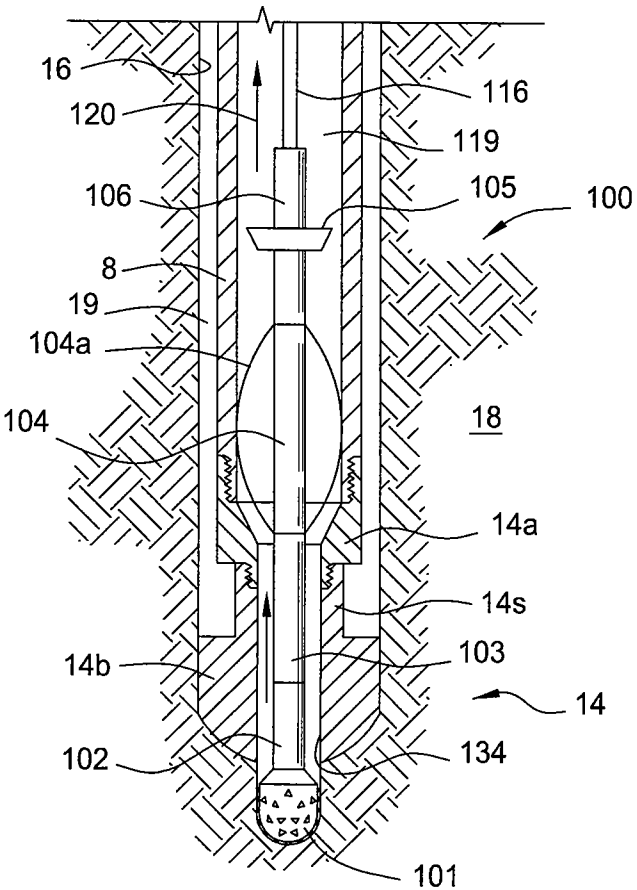
Figure 1A:
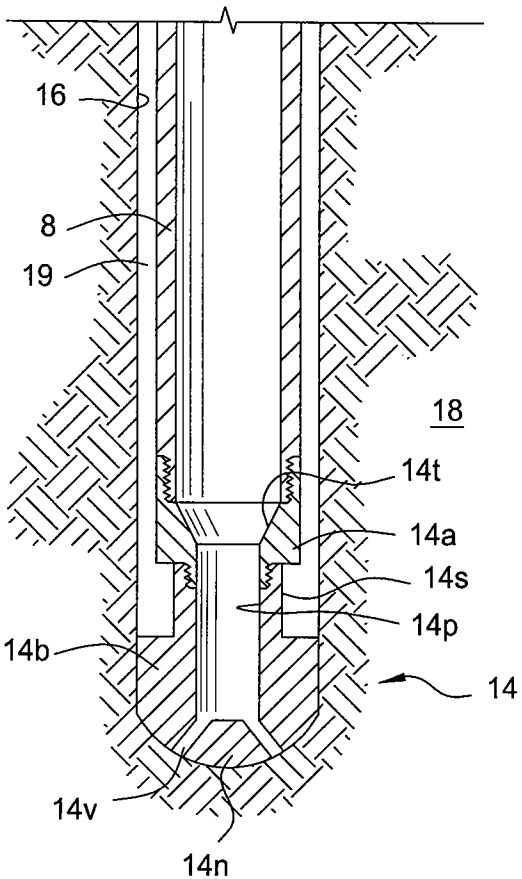
Figure 1C:
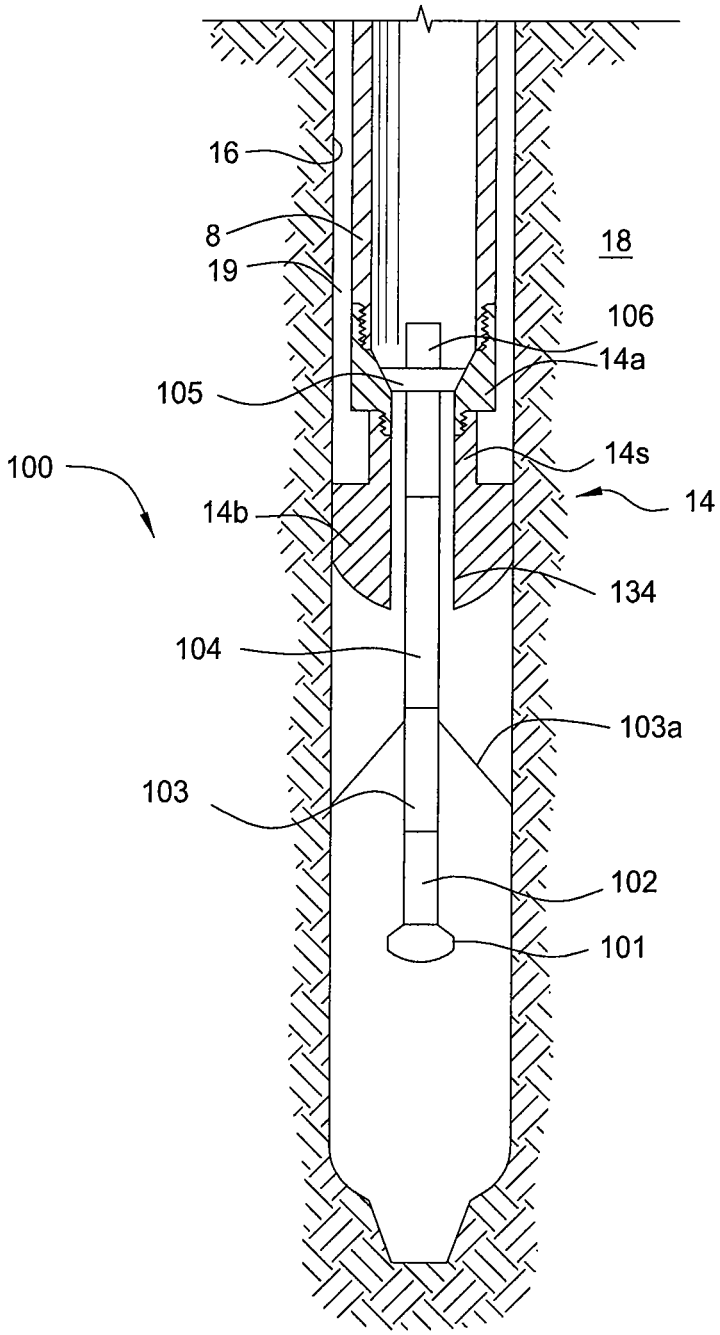

FIGS. 1 and 1A-C illustrate a logging operation conducted through the drillstring 8, according to one embodiment of the present invention. A drilling rig 1 may include a platform 2 supporting a derrick 4 having a traveling block 6 for raising and lowering the drillstring 8. A kelly 10 may rotate the drillstring 8 as the kelly 10 is lowered through a rotary table 12. Alternatively, a top drive (not shown) may be used to rotate the drillstring 8 instead of the Kelly and rotary table. A drill bit 14 may be longitudinally and rotationally connected to the drillstring 8, thereby being driven by rotation of the drillstring. Rotation of the bit 14 may form a wellbore 16 by cutting through one or more formations 18. A pump 20 may circulate drilling fluid 9 through a feed pipe 22 to kelly 10, downhole through the interior passage of drillstring 8, through orifices in drill bit 14, back to the surface via an annulus 19 formed between wellbore 16 and the drillstring 8, and into a retention pit 24. The drilling fluid 9 may transport cuttings from the wellbore 16 into the pit 24 and aid in maintaining the wellbore integrity. The drilling fluid 9 may be mud, gas, mist, foam, or gasified mud. The drillstring 8 may be made from segments of jointed pipe.

Additionally or alternatively, the drill bit 14 may be rotated with a mud motor (not shown). Alternatively the drillstring may be coiled tubing 8 and the bit 14 rotated by a mud motor (not shown) instead of the kelly/top drive.

Once the wellbore 16 has been drilled to a desired depth, such as to a formation boundary, it may be desirable to log the exposed formation 18 before installing a string of casing or liner (not shown). Drilling may be halted by shutting off the rotary table 12 and pump 20. The drillstring 8 may be supported from the platform 2 by a spider (not shown) with the drill bit resting 8 on bottom of the wellbore 16. One or more BOPs (not shown) may then be set against the drillstring 8 to maintain a pressure barrier between the annulus 19 and the surface. The drillstring 8 may include a check valve (not shown) to maintain a pressure barrier between the formation 18 and the surface through the drillstring bore. The kelly 10 or top drive may then be removed. A lubricator (not shown) may be connected to an end of the drillstring at the surface. A BHA 100 may be inserted through the lubricator and into the drillstring 8 at the surface and lowered through a bore of the drillstring to the drill bit 14. A workstring, such as a coiled tubing string 116, may be connected to the BHA 100 and used to lower the BHA through the drillstring bore. The drillstring check valve may be a flapper valve to allow passage of the BHA 100 and coiled tubing 116 therethrough. A surface end of the coiled tubing 116 may be connected to the pump 20.

Alternatively, instead of setting the BOPs and including a check valve in the drillstring 8, the wellbore 16 may be killed prior to removing the kelly 10 by circulating heavy kill fluid into the annulus 19. Alternatively, instead of setting the BOPs, if a top drive is used, then a rotating drilling head (RDH, not shown) may also be used with the drillstring 8, negating the need to set the BOPs.

The BHA 100 may include a mill bit 101, a mud motor 102, a logging tool 103, a centralizer 104, a hanger 105, and a disconnect 106. Each component of the BHA 100 may be longitudinally and torsionally connected to the other components and to the coiled tubing 116. The logging tool 103 may include one or more sondes, such as a formation tester (FT), acoustic sensor, electromagnetic resistivity sensor, galvanic resistivity sensor, seismic sensor, Compton-scatter gamma-gamma density sensor, neutron capture cross section sensor, neutron slowing down length sensor, caliper, core sampler, and/or gravity sensor. The logging tool 103 may further include one or more batteries, one or memory units, and a controller. The BHA 100 may further include a telemetry sub (not shown), such as mud pulse, electromagnetic, RFID, or acoustic, for transmission of logging data to the surface. The telemetry sub may also receive commands from the surface. The BHA 100 may also include one or more check valves for providing a pressure barrier between the formation and the surface via the coiled tubing bore. Alternatively, the workstring 116 may include one or more cables or conduits extending along the workstring, such as electrical, optical, and/or hydraulic, for transmitting and/or receiving data, power, and/or actuation signals to/from the surface.

The BHA 100 may be lowered through the drillstring bore until the hanger 105 engages an opening sleeve of the check valve. Lowering of the opening sleeve may force and hold the flapper open, thereby allowing passage of the BHA 100 through the check valve. The BHA 100 may be further lowered until the mill bit 102 is proximate to the drill bit 14.

The drill bit 14 may be a conventional fixed cutter or drag bit. The drill bit 14 may include a body 14*b* formed from a metal or alloy, usually high strength steel, or a cermet, usually tungsten carbide. The drill bit 14 may further include a threaded steel shank 14*s* extending from the bit body 14*s* for interconnection to the adapter 14*a* or to the drillstring 16. The drill bit 14 may further include blades (not shown) formed on an outer surface of the body 14*b* and a plurality of cutting elements (not shown) disposed in the blades. The cutting elements may be made from a superhard material, such as polycrystalline diamond compact (PDC) or natural diamond. The drill bit 14 may further include a central passage 14*p* and a plurality of ports 14*v* branching from the passage 14*p* and having nozzles (not shown) disposed therein. The adapter 14*a* may have a profile 14*t* formed in an inner surface thereof for seating the hanger 105. Alternatively, the profile 14*t* may be formed in an inner surface of the drillstring 8. Alternatively, the drill bit 8 may be a rolling cutter bit or another type of cutting tool may be used instead of the drill bit, such as an abrasive jet bit, hydraulic cutter, mill bit, or percussion bit.

Drilling fluid 9 may be pumped through the coiled tubing string 116 and the BHA 100. The centralizer 104 may be operable in response to pumping of the fluid to extend members 104*a*, such as bow springs or arms, into engagement with an inner surface of the drillstring 8. The mud motor 102 may include a profiled stator and rotor operable to harness fluid energy from the drilling fluid 9, thereby causing the rotor to rotate relative to the stator and rotate the mill bit 101. Cuttings may be carried by the drilling fluid (collectively returns 120) discharged from nozzles in the mill bit 101 to the surface via an annulus 119 formed between the coiled tubing 116 and the drillstring 8. The returns 120 may be discharged to the pit 24 via a lubricator port.

The rotating mill bit 101 may engage and cut through a nose portion 14*n* of the body 14*b*, thereby forming a bore 134 through the drill bit 14. Milling may be continued past the drill bit 14 and into the formation 18 to ensure that the bore 134 is completely formed through the drill bit 14. Once the bore 134 is formed, milling may be halted. The disconnect 106 may then be operated, such as hydraulically by dropping or pumping a ball through the coiled tubing 116 or by increasing pumping rate of drilling fluid 9 past a predetermined rate. The disconnect 106 may include a housing and a mandrel rotationally coupled by splines formed on each member and longitudinally coupled by a latch. A piston may be connected to the latch and release the latch in response to hydraulic force exerted on the piston.

Once disconnected, the coiled tubing 116 and released portion of the disconnect 106 may be raised until the released portion of the disconnect 106 reaches the check valve sleeve. Arms (not shown) may be extended from the disconnect 106, such as hydraulically by dropping or pumping down a ball, to engage the check valve sleeve. The coiled tubing 116 may then be raised to move the check valve sleeve from engagement with the flapper, thereby allowing the check valve to close. The coiled tubing 116 may then be removed from the wellbore 16. The lubricator may then be removed from the drillstring 8. The drillstring 8 may then be raised from the bottom of the wellbore 16 until the adapter profile 14*t* engages the hanger 105, thereby longitudinally connecting the drillstring and the remaining BHA 100 and causing the logging tool 103 to be inserted through the bore 134. The logging tool 103 may be completely inserted through the bore so that the drillstring 8/drill bit 14 does not cause interference between the logging tool 103 and the exposed formation 18. The logging tool 103 may be separated from the drill bit 14 by a predetermined longitudinal distance to ensure interference-free communication between the logging tool 103 and the exposed formation 18.

Alternatively, the drillstring 8 may be raised before insertion of the BHA 100 and milling through the drill bit 14. The hanger 105 may then be set into the profile after mill through.

The logging tool 103 may include a sensor to detect release of the BHA 100 or engagement of the hanger 105 with the profile 14*t* to begin logging. The logging tool 103 may extend arms 103*a* in response to engagement of the hanger 105 with the profile 14*t*. The arms 103*a* may be part of one of the sondes, such as a formation tester or caliper, or included to centralize the logging tool. Alternatively, the arms 103*a* may be omitted and the centralizer 104 may remain in the extended position after milling the bore 134. The exposed formation 18 may then be logged as the drillstring 8 is tripped from the wellbore. Logging data may be downloaded from the logging tool memory unit when the logging tool is retrieved from the drillstring at the surface. Additionally, at least some of the logging data may be transmitted to the surface during tripping by the telemetry sub. Alternatively or additionally, the exposed formation 18 may be logged as the drillstring 8 is tripped into the wellbore.

Alternatively, to facilitate mill through of the drill bit 14 or allow drill through of the drill bit 14 with a conventional drill bit instead of a mill bit, the drill bit nose 14*n* may be made drillable as discussed in U.S. Pat. Nos. 5,950,742 and 7,395,882, which are hereby incorporated by reference in their entireties. The nose 14*n* may be made from a drillable material, such as low strength steel, bronze, brass, carbon-fiber composite, or aluminum. Alternatively, the drill bit body 14*b* and nose 14*n* may be made from the drillable material. To compensate for softness of the drillable material, the nose 14*n* and/or body 14*b* may be hard-faced to resist erosion. Alternatively, the nose 14*n* may be made from a conventional high strength material but the thickness reduced to facilitate drill through. Additionally, the thin high strength nose may be reinforced by an inner core (not shown) of drillable material.

Alternatively, the nose may be pre-weakened or scored and then displaced outward using mechanical force, hydraulic force, or an explosive shape charge, thereby forming the opening. In this alternative, the mill bit and mud motor may be omitted and the BHA deployed using slickline or wireline instead of coiled tubing. The mechanical force may be exerted by setting weight of the BHA onto the nose or by latching a setting tool to an inner surface of the drillstring and operating the setting tool. Hydraulic force may be exerted by circulating drilling fluid at a predetermined rate through the drill bit. The shape charge may be delivered as discussed below.

Although illustrated as a vertical wellbore 16, the wellbore 16 may include a deviated or horizontal section (not shown). To facilitate lowering of the BHA 100 to the drill bit 14, the BHA 100 may be pumped in by injecting drilling fluid 9 into the drillstring bore through the lubricator and receiving fluid via a port of the BOP/RDH. The hanger 105 may include a seal (not shown) engaging an inner surface of the drillstring 8 to facilitate pump in. The seal may be directional, i.e. a cup seal, so as to only engage when pumping.

Alternatively, an outer surface of the hanger and an inner surface of the drillstring may form a choke to facilitate pump in. Alternatively, the BHA may include a pump plug (not shown) to facilitate pump in. A suitable pump plug is discussed and illustrated in US Pat. App. Pub. No. 2006/0266512, which is hereby incorporated by reference in its entirety. The pump plug may include a resilient body and a flexible cage having a wear-resistant outer surface arranged around the resilient body. The flexible cage may be a tube having a first end and a second end and having a repeating pattern of slits formed through a wall of the tube, the slits being closed at least one end. The body may be made from a polymer, such as an elastomer (i.e., rubber) and the cage may be made from a metal, alloy, ceramic, or cermet. The body and cage may be bonded together, such as by molding. The plug may be sized so that the cage outer surface engages an inner surface of the drill string, thereby sealingly engaging the plug and the drill string.

Alternatively, the BHA 100 may include a tractor (not shown) for propelling the BHA 100 to the drill bit 14. The tractor may be connected above the disconnect 106 and retrieved with the coiled tubing 116 or below the disconnect 106 and retrieved with the BHA 100 when the drillstring is tripped. The tractor may be conventional or the tractor 904 (discussed below).

Figure 2A:
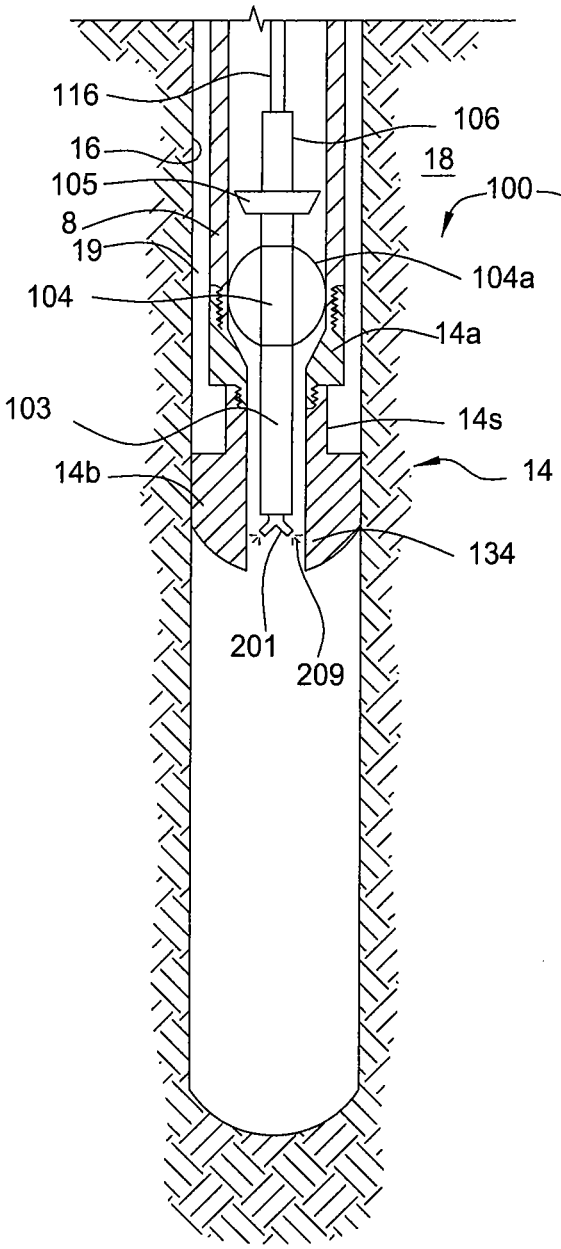
FIGS. 2A and 2B illustrate a method for forming a bore through the drillstring, according to other embodiments of the present invention.

FIG. 2A illustrates a method for forming the drillstring bore 134, according to another embodiment of the present invention. A nozzle 201 may replace the mill bit 101 and motor 102. An abrasive fluid 209 may be injected through the coiled tubing 116 and the nozzle 201. The abrasive fluid 209 may be discharged by the nozzle 201 as a high speed jet impinging on the drill bit nose 14*n*, thereby forming the bore 134 by erosion. The abrasive fluid 209 may include solid particulates disbursed in a liquid, such as water. The particulates may be made from a super hard material, such as sand. The nozzle 201 may be made from an erosion resistant material, such as tungsten carbide cermet. Alternatively, an acid may be used instead of the abrasive fluid and the BHA 100 and coiled tubing 116 may be made from an acid resistant alloy.

Figure 2B:
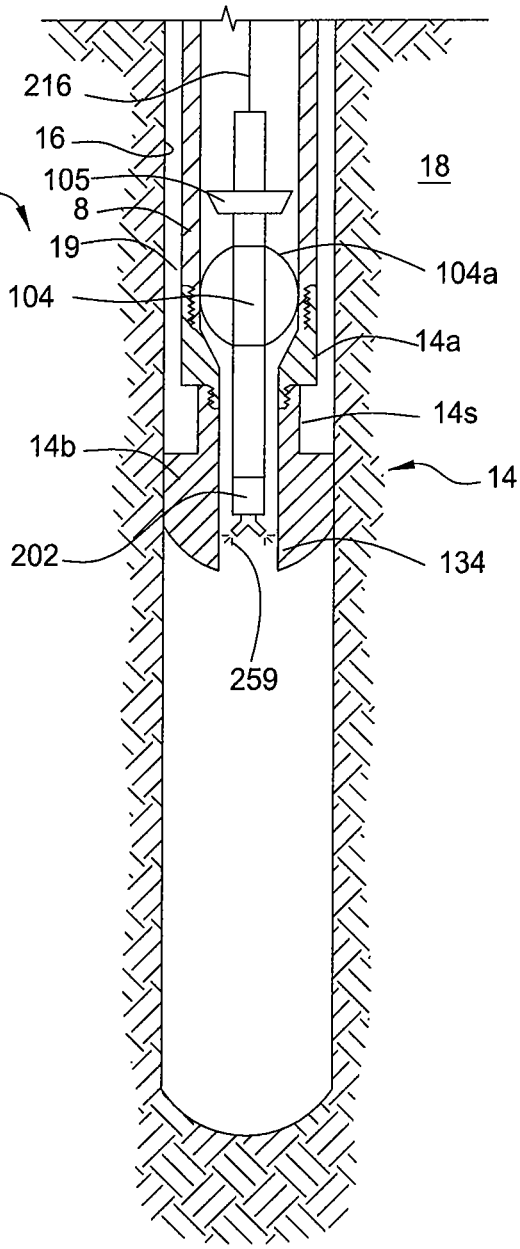

FIG. 2B illustrates a method for forming the drillstring bore 134, according to another embodiment of the present invention. Instead of injecting the abrasive fluid from the surface, the BHA 100 may include an ignitable charge 202, such as thermite. The BHA 100 may also be deployed by wireline 216 instead of coiled tubing 116. The centralizer 104 and disconnect 106 may be electrically operated by electricity received from the wireline 216. The charge 202 may be ignited by electricity received from the wireline. High temperature combustion products 259 may be discharged through the nozzle 201 and against the drill bit nose 14*n*, thereby melting the nose and forming the bore. Alternatively, an explosive, such as a shape charge, or other combustible material may be used in the charge instead of thermite for blasting through the nose 14*n*. Alternatively, slickline may be used instead of wireline.

Figure 3A:
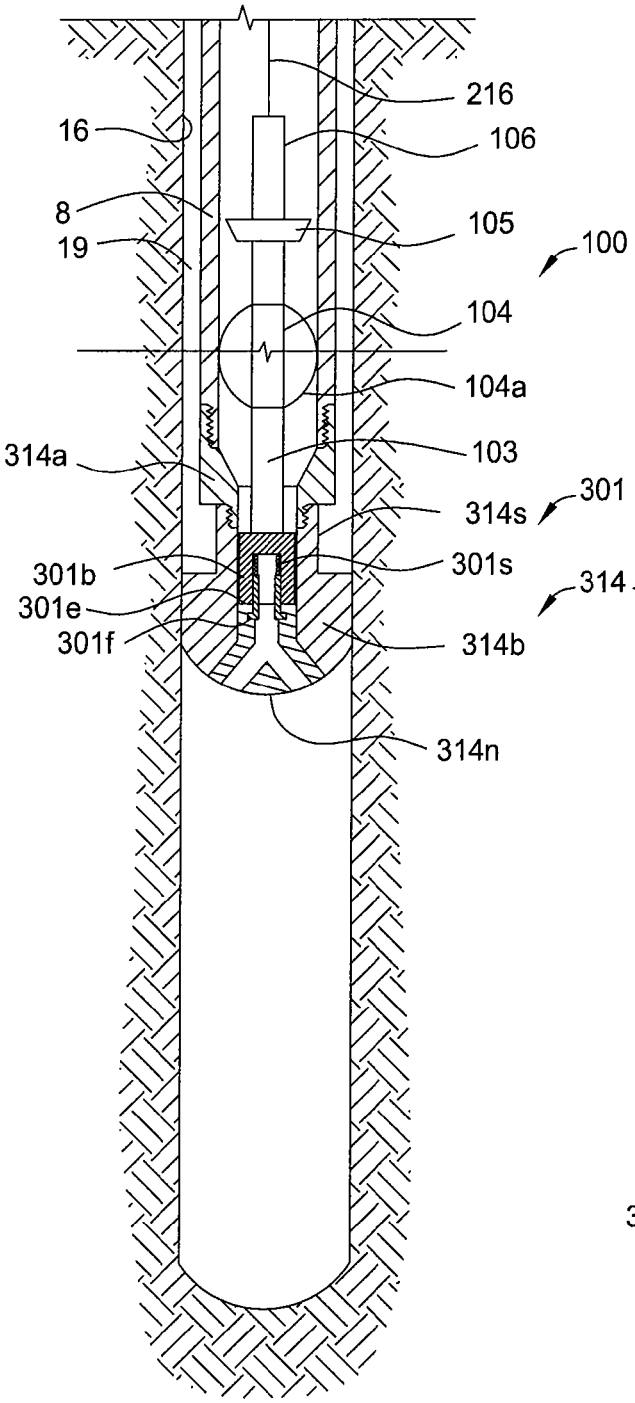
FIGS. 3A and 3B illustrate a logging operation conducted through the drillstring, according to another embodiment of the present invention.
Figure 3B:
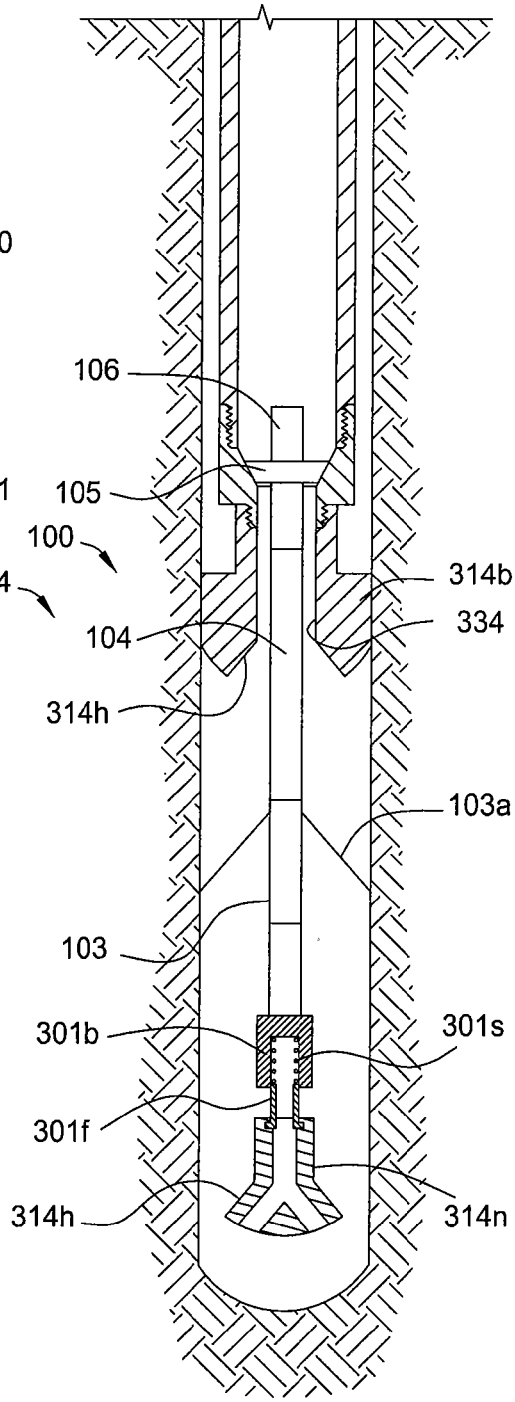

FIGS. 3A and 3B illustrate a logging operation conducted through the drillstring 8, according to another embodiment of the present invention. A drill bit 314 has replaced the drill bit 14. The drill bit 314 may include a body 314*b*, nose 314*n*, shank 314*s* and adapter 314*a*. The drill bit 314 may be similar to the drill bit 14 except that the nose 314*n* is formed separately from the body 314*b*. The nose 314*n* may be longitudinally and torsionally connected to the body, such as by an interference fit and mating shoulders 314*h*. The shoulders 314*h* may rigidly connect the nose 314*n* and the body 314*b* for longitudinal compression therebetween and also provide a metal-to-metal seal between the nose 314*n* and the body 314*b*. Alternatively or additionally, a polymer seal, such as an o-ring (not shown) may be disposed between the nose 314*n* and the body 314*b*. The nose 314*n* may be received by a bore 334 preformed through the body.

To remove the nose 314*n* from the body 314*b*, the drillstring 8 may be raised to raise the drill bit 314 from the bottom of the wellbore 16. The BHA 100 may be deployed through the drillstring bore using the wireline 216. The BHA 100 may include an actuator 301 instead of the mill bit 101 and mud motor 102. The actuator 301 may include a body 301*b*, a latch 301*f*, and a biasing member, such as a spring 301*s*. The latch 301*f* may include one or more fasteners, such as collet fingers or dogs. As the actuator 301 is lowered into the drill bit 314, the fasteners 301*f* may engage a corresponding profile 314*r* formed in the inner surface of the nose 314*n*. The spring 301*s* may allow the actuator 301 to be further lowered until a shoulder or bottom 301*e* of the actuator body 301*b* seats against a top or shoulder of the nose 314*n*. The BHA 100 may continue to be lowered, thereby relieving tension in the wireline 216 and transferring weight of the BHA 100 to the nose 314*n*. Once a predetermined weight is exerted to overcome the interference fit, the nose 314*n* may release from the body 314*b*. The latch 301*f* may keep the nose 314*n* longitudinally coupled to the actuator 301, thereby preventing loss of the nose 314*n* in the wellbore 16. Once the nose 314*n* is released from the body, logging tool 103 may be inserted through the open bore 334 and the logging operation may proceed as discussed above.

Alternatively, as discussed above, the nose 314*n* may be drillable, the latch may be omitted, and the nose may be abandoned in the wellbore to be later drilled through. Alternatively, the actuator may be a setting tool (not shown) including an anchor (see FIG. 4A) for engaging an inner surface of the drillstring or a latch for engaging a profile formed in an inner surface of the drillstring, a piston, and a power charge. Once the setting tool is anchored/latched, the power charge may be ignited, thereby pushing the piston against the nose and releasing the nose from the body. Alternatively, the setting tool may include an electric motor for pushing a setting sleeve against the nose. Alternatively, the setting tool may be hydraulically operated and the BHA may be deployed using coiled tubing instead of wireline. Alternatively, the actuator may be a jar or vibrating jar and be latched or anchored to an inner surface of the drillstring and be operated by injecting drilling fluid through the drillstring or deployed using coiled tubing and operated by injecting drilling fluid through the coiled tubing.

Alternatively, instead of seating the BHA 100 in the drill bit 314 and logging the formation 18 while tripping the drillstring 8 from the wellbore, the drillstring may be raised to a top of the exposed formation 18, the exposed formation logged with the wireline connected and transmitting logging data to the surface, and the nose may then be re-installed in the body. The BHA and wireline may then be removed from the wellbore. The BHA may be removed by pulling the workstring and/or reverse circulation of fluid. The drill string 8 may then be tripped from the wellbore so that casing may be installed or drilling of the wellbore may recommence through a second formation (not shown) without tripping the drillstring from the wellbore. If drilling is recommenced, once the second formation is drilled through, the BHA may be redeployed, the nose again removed from the drill bit, and the second formation logged.

Additionally or alternatively, the drillstring 8 may include a drilling BHA (not shown) having the drill bit 314 and a mud motor, an MWD tool, an LWD tool, instrumentation tool (i.e., pressure sensor), orienter, and/or telemetry tool. The drilling BHA may be connected to the nose 314*n* and the actuator 301 may engage the drilling BHA and remove the drilling BHA with the nose 314*n*.

Figure 4A:
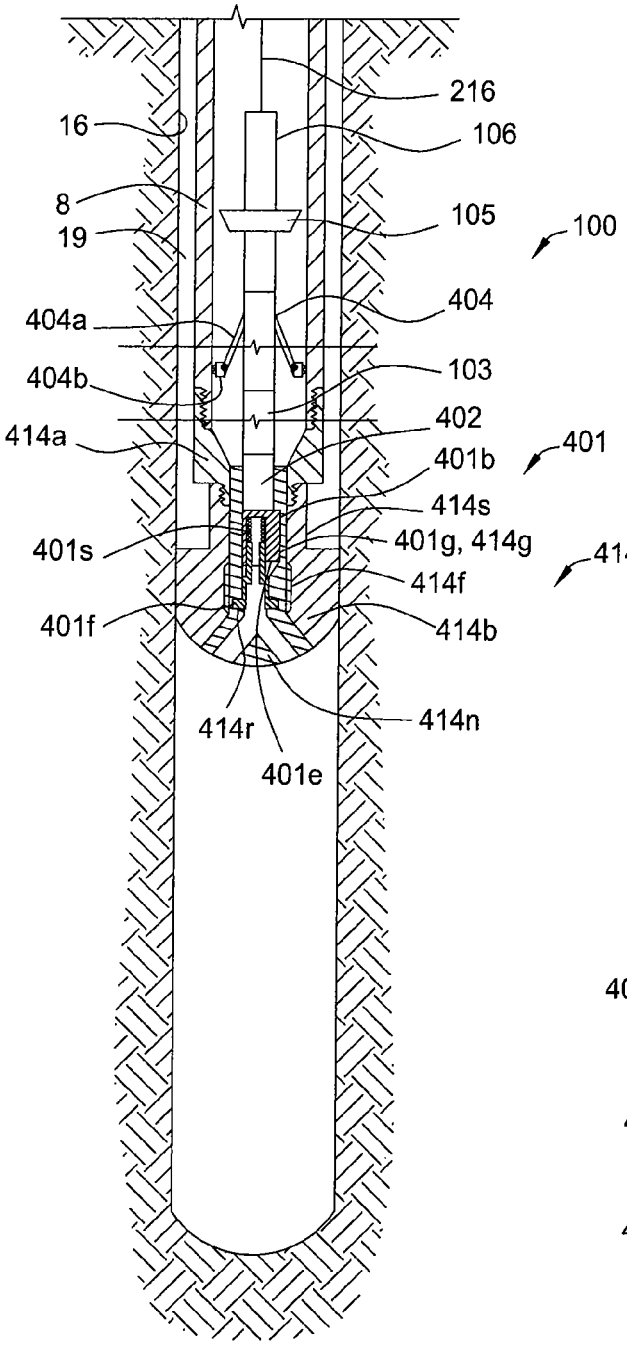
FIGS. 4A and 4B illustrate a logging operation conducted through the drillstring, according to another embodiment of the present invention.
Figure 4B:
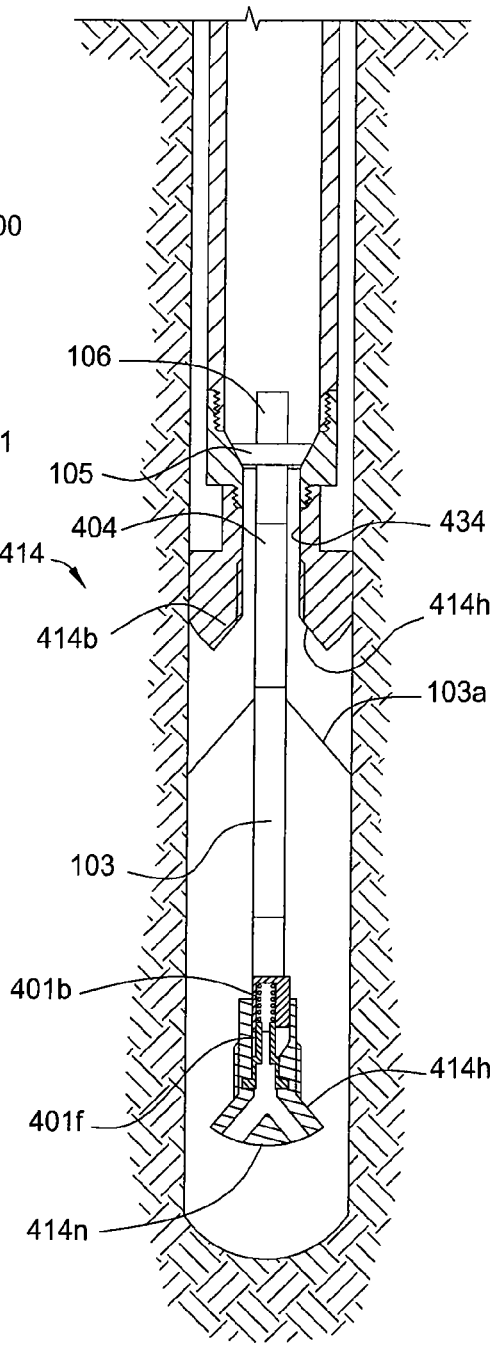

FIGS. 4A and 4B illustrate a logging operation conducted through the drillstring 8, according to another embodiment of the present invention. A drill bit 414 has replaced the drill bit 14. The drill bit 414 may include a body 414*b*, nose 414*n*, shank 414*s*, and adapter 414*a*. The drill bit 414 may be similar to the drill bit 14 except that the nose 414*n* is formed separately from the body 414*b*. The nose 414*n* may be longitudinally and torsionally connected to the body, such as by a threaded connection 414*f*, and mating shoulders 414*h*. The shoulders 414*h* may rigidly connect the nose and the body for longitudinal compression therebetween and also provide a metal-to-metal seal between the nose and the body. Alternatively or additionally, a polymer seal, such as an o-ring (not shown) may be disposed between the nose 414*n* and the body 414*b*. The nose 414*n* may be received by a bore 434 preformed through the body.

To remove the nose 414*n* from the body 414*b*, the drillstring 8 may be raised to raise the drill bit 414 from the bottom of the wellbore 16. The BHA 100 may be deployed through the drillstring bore using the wireline 216. The BHA 100 may include an actuator 401 and an electric motor 402 instead of the mill bit 101 and mud motor 102. The BHA 100 may further include an anchor 404 instead of the centralizer 104. The actuator 401 may include a body 401*b*, a latch 401*f*, and a biasing member, such as a spring 401*s*. A profile, such as a spline 401*g*, may be formed in the outer surface of the body 401*b* for mating with a corresponding profile 414*g* formed in an inner surface of the nose. The latch 401*f* may include one or more fasteners, such as collet fingers or dogs. As the actuator 401 is lowered into the drill bit 414, the fasteners 401*f* may engage a corresponding profile 401*r* formed in the inner surface of the nose 414*n*. The spring 401*s* may allow the actuator 401 to be further lowered until an end 401*e* of the actuator spline 401*g* engages with an end of the nose spline 414*g*. The anchor 404 may include an electric motor for extending arms 404*a* outward toward an inner surface of the drillstring 8. A die 404*d* may be pivoted to an end of each arm 404*a* for engaging an inner surface of the drillstring 8, thereby torsionally connecting the BHA 100 to the drillstring. The motor 402 may then be operated, thereby rotating the actuator body and unthreading the nose from the body. The latch 401*f* may keep the nose 414*n* longitudinally coupled to the actuator 401, thereby preventing loss of the nose 414*n* in the wellbore 16. Once the nose 414*n* is released from the body, logging tool 103 may be inserted through the open bore 434 and the logging operation may proceed as discussed above.

Alternatively, as discussed above, the nose 414*n* may be drillable, the latch may be omitted, and the nose may be abandoned in the wellbore to be later drilled through. Alternatively, the anchor may be a latch for engaging a profile formed in an inner surface of the drillstring. Alternatively, instead of seating the BHA in the drill bit and logging the formation while tripping the drillstring from the wellbore, the drillstring may be raised to a top of the exposed formation, the exposed formation logged with the wireline connected and transmitting logging data to the surface, and the nose may then be re-installed in the body. The BHA and wireline may then be removed from the wellbore and drilling may resume.

Figure 5A:
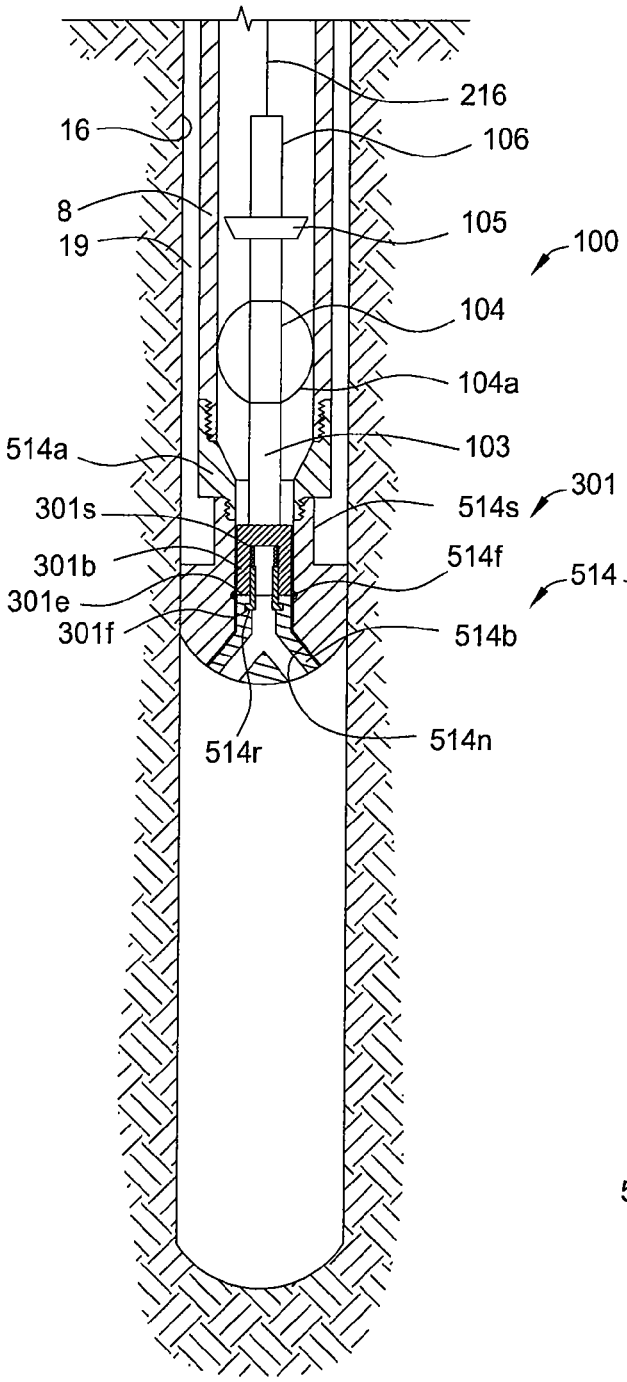
FIGS. 5A and 5B illustrate a logging operation conducted through the drillstring, according to another embodiment of the present invention.
Figure 5B:
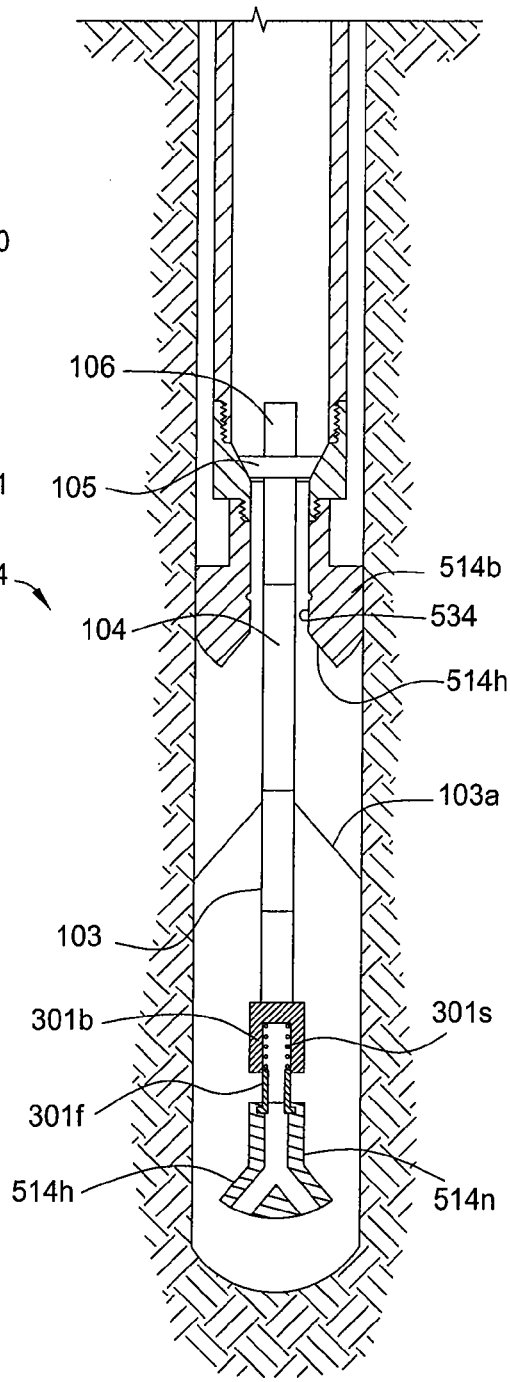

FIGS. 5A and 5B illustrate a logging operation conducted through the drillstring 8, according to another embodiment of the present invention. A drill bit 514 has replaced the drill bit 14. The drill bit 514 may include a body 514*b*, nose 514*n*, shank 514*s* and adapter 514*a*. The drill bit 514 may be similar to the drill bit 14 except that the nose 514*n* is formed separately from the body 514*b*. The nose 514*n* may be longitudinally and torsionally connected to the body, such as by one or more frangible fasteners 514*f* and mating shoulders 514*h*. The shoulders 514*h* may rigidly connect the nose 514*n* and the body 514*b* for longitudinal compression therebetween and also provide a metal-to-metal seal between the nose 514*n* and the body 514*b*. Alternatively or additionally, a polymer seal, such as an o-ring (not shown) may be disposed between the nose 514*n* and the body 514*b*. The nose 514*n* may be received by a bore 534 preformed through the body.

To remove the nose 514*n* from the body 514*b*, the drillstring 8 may be raised to raise the drill bit 314 from the bottom of the wellbore 16. The BHA 100 may be deployed through the drillstring bore using the wireline 216. The BHA 100 may include the actuator 301 instead of the mill bit 101 and mud motor 102. As the actuator 301 is lowered into the drill bit 314, the fasteners 301*f* may engage a corresponding profile 514*r* formed in the inner surface of the nose 514*n*. The spring 301*s* may allow the actuator 301 to be further lowered until the shoulder or bottom 301*e* body 301*b* seats against a top or shoulder of the nose 514*n*. The BHA 100 may continue to be lowered, thereby relieving tension in the wireline 216 and transferring weight of the BHA 100 to the nose 514*n*. Once a predetermined weight is exerted to fracture the fasteners 514*f*, the nose 514*n* may release from the body 514*b*. The latch 301*f* may keep the nose 514*n* longitudinally coupled to the actuator 301, thereby preventing loss of the nose 514*n* in the wellbore 16. Once the nose 514*n* is released from the body, logging tool 103 may be inserted through the open bore 534 and the logging operation may proceed as discussed above.

Alternatively, the fasteners 514*f* may be made from a low melting point material relative to the nose and body and the BHA 100 deployed using coiled tubing. The body of the actuator may be modified to include one or more nozzles directed toward the fatteners. Heated fluid may then be discharged from the nozzles and impinge on the fasteners, thereby melting the fasteners and releasing the nose from the body. Alternatively, the fasteners 514*f* may be made from a material having a high brittle transition temperature relative to the nose and body and the BHA deployed using coiled tubing. Refrigerated fluid may then be discharged from the nozzles and impinge on the fasteners, thereby freezing the fasteners to a brittle state and releasing the nose from the body. Alternatively, the fasteners 514*f* may be made from a corrosion susceptible material relative to the nose and body and the BHA deployed using coiled tubing. The body of the actuator may be modified to include one or more nozzles directed toward the fatteners. Corrosive fluid, such as acid, may then be discharged from the nozzles and impinge on the fasteners, thereby dissolving the fasteners and releasing the nose from the body. Alternatively, the fasteners 414*f* may be displaceable into a profile formed in the body or the nose by the application of force, such as snap rings, collet fingers, or dogs.

Alternatively, as discussed above, the nose 514*n* may be drillable, the latch may be omitted, and the nose may be abandoned in the wellbore to be later drilled through. Alternatively, the actuator may be a setting tool (not shown) including an anchor (see FIG. 4A) for engaging an inner surface of the drillstring or a latch for engaging a profile formed in an inner surface of the drillstring, a piston, and a power charge. Once the setting tool is anchored/latched, the power charge may be ignited, thereby pushing the piston against the nose and releasing the nose from the body. Alternatively, the setting tool may include an electric motor for pushing a setting sleeve against the nose. Alternatively, the setting tool may be hydraulically operated and the BHA may be deployed using coiled tubing instead of wireline. Alternatively, the actuator may be a jar or vibrating jar and be latched or anchored to an inner surface of the drillstring and be operated by injecting drilling fluid through the drillstring or deployed using coiled tubing and operated by injecting drilling fluid through the coiled tubing.

Alternatively, instead of seating the BHA in the drill bit and logging the formation while tripping the drillstring from the wellbore, the drillstring may be raised to a top of the exposed formation, the exposed formation logged with the wireline connected and transmitting logging data to the surface, and the nose may then be re-installed in the body. The BHA and wireline may then be removed from the wellbore and drilling may resume.

Figure 6B:
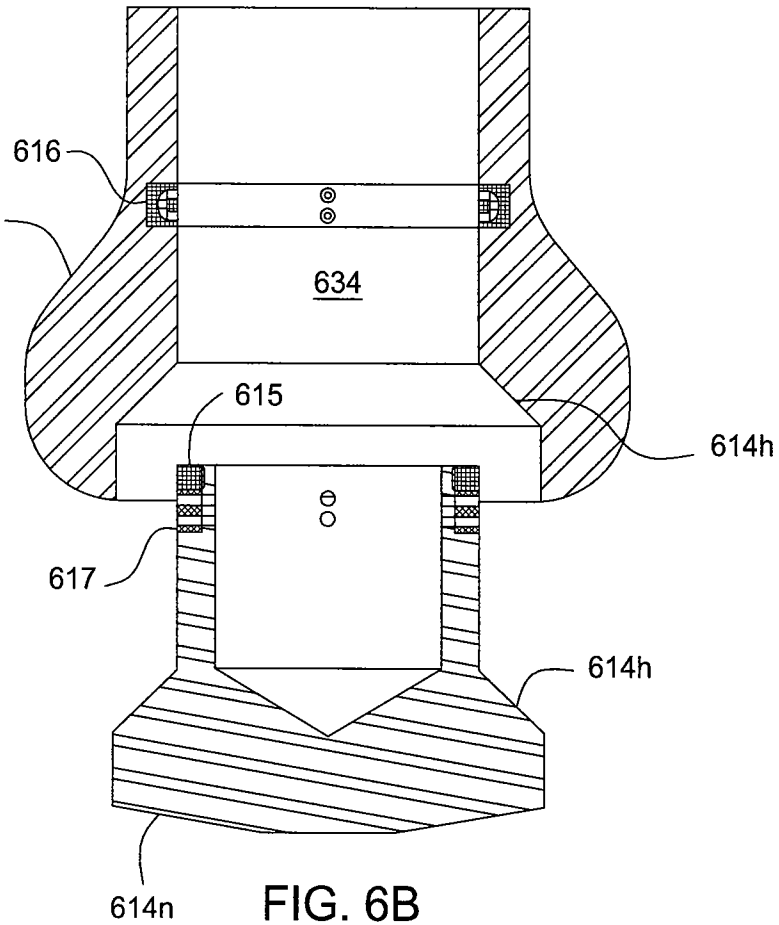
FIGS. 6A and 6B illustrate a drill bit usable in a logging operation conducted through the drillstring, according to another embodiment of the present invention.
Figure 6A:
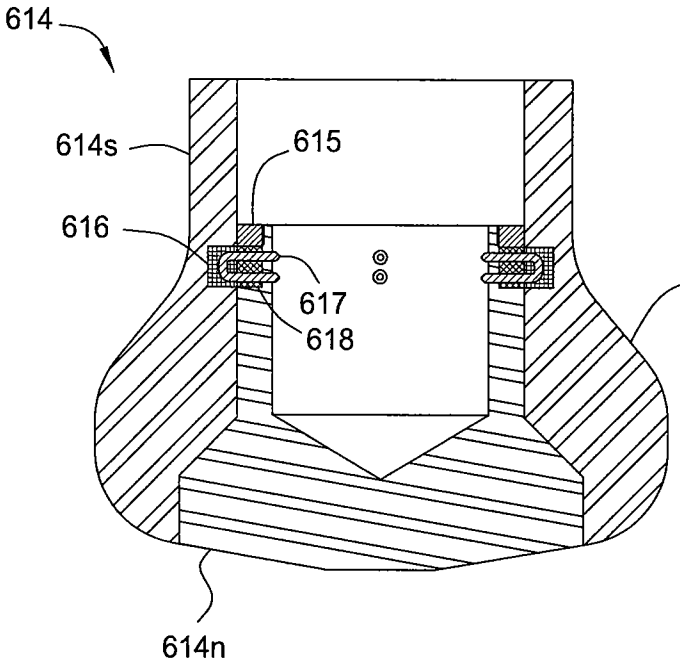

FIGS. 6A and 6B illustrate a drill bit 614 usable in a logging operation conducted through the drillstring, according to another embodiment of the present invention. The drill bit 614 may include a body 614*b*, nose 614*n*, shank 614*s* and adapter (not shown). The drill bit 614 may be similar to the drill bit 14 except that the nose 614*n* is formed separately from the body 614*b*. The nose 614*n* may be longitudinally connected to the body, such as with a fusible fastener 615-618 and mating shoulders 614*h*. The shoulders 614*h* may rigidly connect the nose 614*n* and the body 614*b* for longitudinal compression therebetween and also provide a metal-to-metal seal between the nose 614*n* and the body 614*b*. Alternatively or additionally, a polymer seal, such as an o-ring (not shown) may be disposed between the nose 614*n* and the body 614*b*. The nose 614*n* may be received by a bore 634 preformed through the body. The nose 614*n* and the body 614*b* may have mating torsional profiles (not shown), such as splines, for torsionally connecting the body and the nose. The nose may further have a profile (not shown) formed on an inner surface thereof for receiving the latch of the actuator.

The fastener may include one or more wires 617 encased in an outer layer 616 and an inner jacket 618 of dielectric material. The layer 616 and the wires 617 may be disposed a profile, such as a groove, formed in the inner surface of the body 614*b*. The wires 617 may be made from an electrically conductive material, such as a metal or alloy. Each wire 617 may extend through an opening formed through a wall of the nose 614*n* and ends of each wire may extend into the central nose passage. The inner jacket 618 may isolate the wire from the nose wall. The jacket 618 and wire 617 may be retained in the nose opening by a fastener 615, such as a threaded ring engaged with a threaded groove formed in an outer surface of the nose.

To remove the nose 614*n* from the body 614*b*, the drillstring may be raised to raise the drill bit 614 from the bottom of the wellbore. The BHA may be deployed through the drillstring bore using the wireline. The BHA may include an actuator. The actuator may include an electrical contact corresponding to each end of the wire 617 extending through the nose openings. As the actuator seats against a top or shoulder of the nose 614*n*, each contact may engage a respective end of each wire. Electricity may then be supplied through the wire, thereby heating the wire until the melting point is reached and releasing the nose from the body 614*b*. Once the nose 614*n* is released from the body, the logging tool may be inserted through the open bore 634 and the logging operation may proceed as discussed above.

Alternatively, instead of physical contact with the wire, the actuator may include an inductive coupling and wirelessly transmit the electricity to the wire.

Figures 7A, 7B:
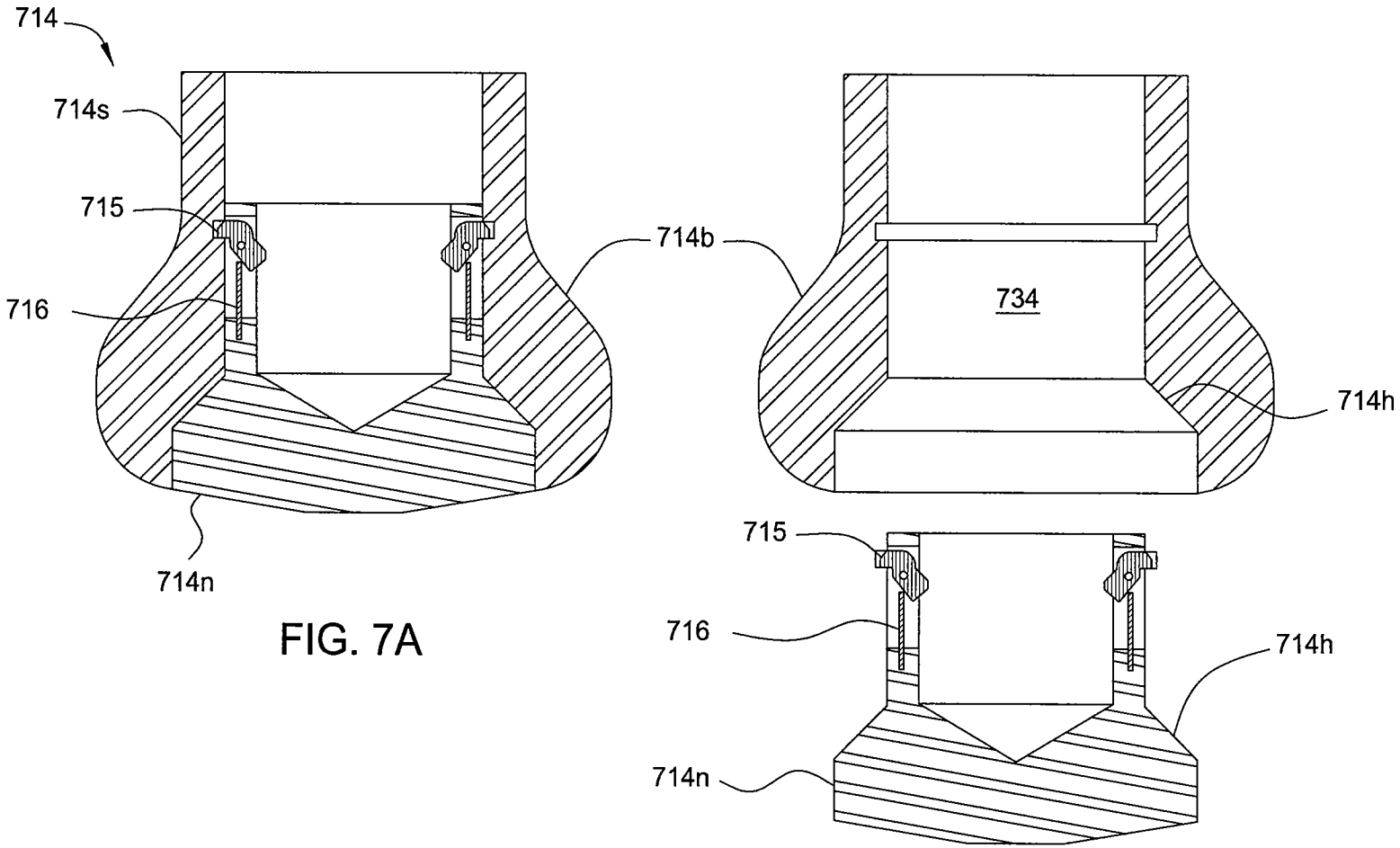
FIGS. 7A and 7B illustrate a drill bit usable in a logging operation conducted through the drillstring, according to another embodiment of the present invention.

FIGS. 7A and 7B illustrate a drill bit 714 usable in a logging operation conducted through the drillstring, according to another embodiment of the present invention. The drill bit 714 may include a body 714*b*, nose 714*n*, shank 714*s* and adapter (not shown). The drill bit 714 may be similar to the drill bit 14 except that the nose 714*n* is formed separately from the body 714*b*. The nose 714*n* may be longitudinally connected to the body, such as with a latch 715, 716 and mating shoulders 714*h*. The shoulders 714*h* may rigidly connect the nose 714*n* and the body 714*b* for longitudinal compression therebetween and also provide a metal-to-metal seal between the nose 714*n* and the body 714*b*. Alternatively or additionally, a polymer seal, such as an o-ring (not shown) may be disposed between the nose 714*n* and the body 714*b*. The nose 714*n* may be received by a bore 734 preformed through the body. The nose 714*n* and the body 714*b* may have mating torsional profiles (not shown), such as splines, for torsionally connecting the body and the nose. The nose may further have a profile (not shown) formed on an inner surface thereof for receiving the latch of the actuator.

The latch may include one or more fasteners such as cams 715, pivoted to the nose and biased into engagement with the body by a respective spring, such as a leaf 716 having an end attached to the nose. Each cam 715 and spring 716 may be disposed in a slot formed through a wall of the nose. A first profile of each cam 715 may engage a profile, such as a groove, formed in an inner surface of the body 714*b*. A second profile of each cam 715 may extend through the slot for receiving a sleeve of the actuator.

To remove the nose 714*n* from the body 714*b*, the drillstring may be raised to raise the drill bit 714 from the bottom of the wellbore. The BHA may be deployed through the drillstring bore using the wireline. The BHA may include an actuator. The actuator may include a sleeve for engaging the second cam surface. As the actuator is lowered, the actuator sleeve may push the second cam surface, thereby rotating each cam about the cam pivot and against the spring. Rotation of the cam may disengage the first cam surface from the body profile, thereby releasing the nose from the body 714*b*. Once the nose 714*n* is released from the body, the logging tool may be inserted through the open bore 734 and the logging operation may proceed as discussed above.

Figure 8B:
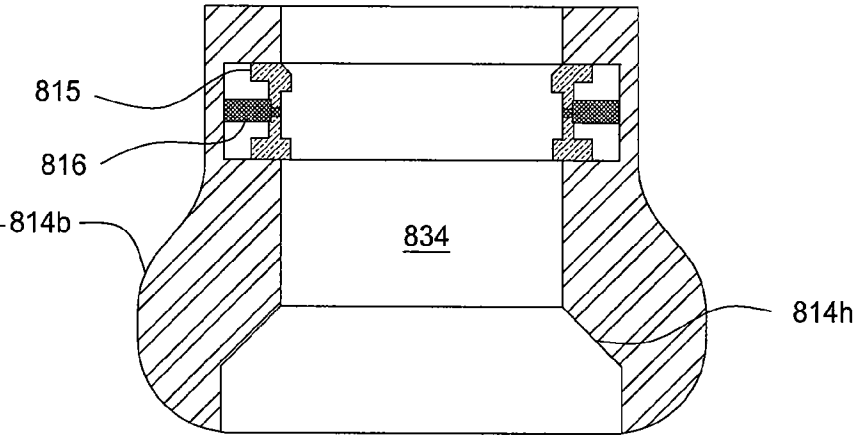
FIGS. 8A and 8B illustrate a drill bit usable in a logging operation conducted through the drillstring, according to another embodiment of the present invention.
Figure 8B:
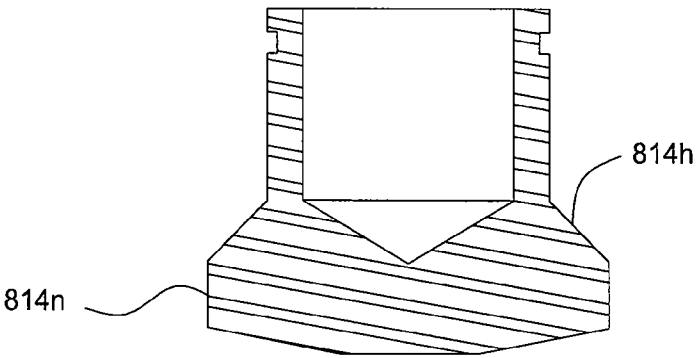
Figure 8A:
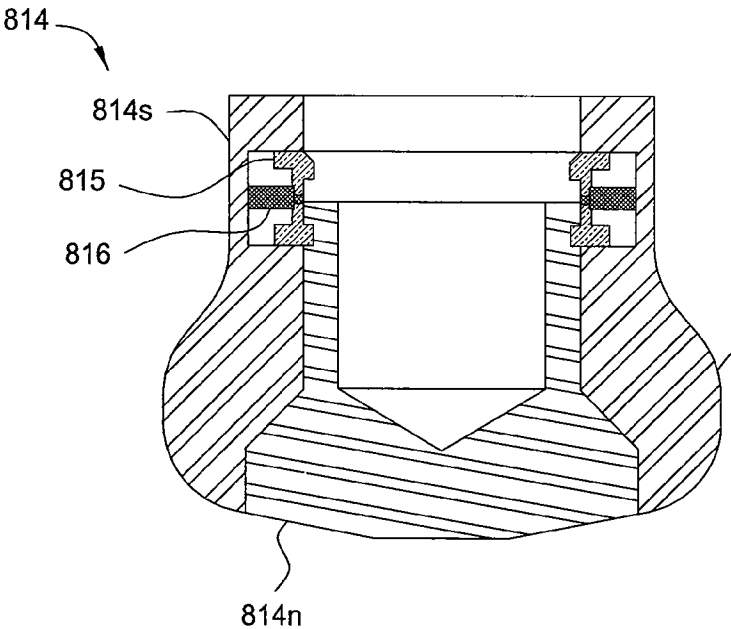

FIGS. 8A and 8B illustrate a drill bit 814 usable in a logging operation conducted through the drillstring, according to another embodiment of the present invention. The drill bit 814 may include a body 814*b*, nose 814*n*, shank 814*s* and adapter (not shown). The drill bit 814 may be similar to the drill bit 14 except that the nose 814*n* is formed separately from the body 814*b*. The nose 814*n* may be longitudinally connected to the body, such as with a latch 815, 816 and mating shoulders 814*h*. The shoulders 814*h* may rigidly connect the nose 814*n* and the body 814*b* for longitudinal compression therebetween and also provide a metal-to-metal seal between the nose 814*n* and the body 814*b*. Alternatively or additionally, a polymer seal, such as an o-ring (not shown) may be disposed between the nose 814*n* and the body 814*b*. The nose 814*n* may be received by a bore 834 preformed through the body. The nose 814*n* and the body 814*b* may have mating torsional profiles (not shown), such as splines, for torsionally connecting the body and the nose. The nose may further have a profile (not shown) formed on an inner surface thereof for receiving the latch of the actuator.

The latch may include one or more fasteners 815, such as blocks, disposed in a slot formed in an inner surface of the body 814*b* and biased into engagement with the nose 814*n* by a respective spring 816. A lock profile formed in each block may engage a mating profile, such as a groove, formed in an outer surface of the nose 814*n*. A cam profile of each block 815 may extend into the body bore 834 for receiving a sleeve of the actuator.

To remove the nose 814*n* from the body 814*b*, the drillstring may be raised to raise the drill bit 814 from the bottom of the wellbore. The BHA may be deployed through the drillstring bore using the wireline. The BHA may include an actuator. The actuator may include a sleeve for engaging the cam profile. As the actuator is lowered, the actuator sleeve may push the cam profile, thereby radially moving each block inward against the respective spring, disengaging the lock profile from the nose profile, and releasing the nose from the body 814*b*. Once the nose 814*n* is released from the body, the logging tool may be inserted through the open bore 834 and the logging operation may proceed as discussed above.

In another embodiment (not shown), the nose may be longitudinally connected to the body by one or more permanent magnets connected to either the nose or the body and the other of the nose and the body may be made from a magnetic material. The nose may be released as discussed above in relation to FIGS. 3A and 3B. Alternatively, for either of the latched bits 714, 814, the latches may be disengaged by an actuator having an electromagnet instead of engaging the latches with a sleeve.

Figure 9:
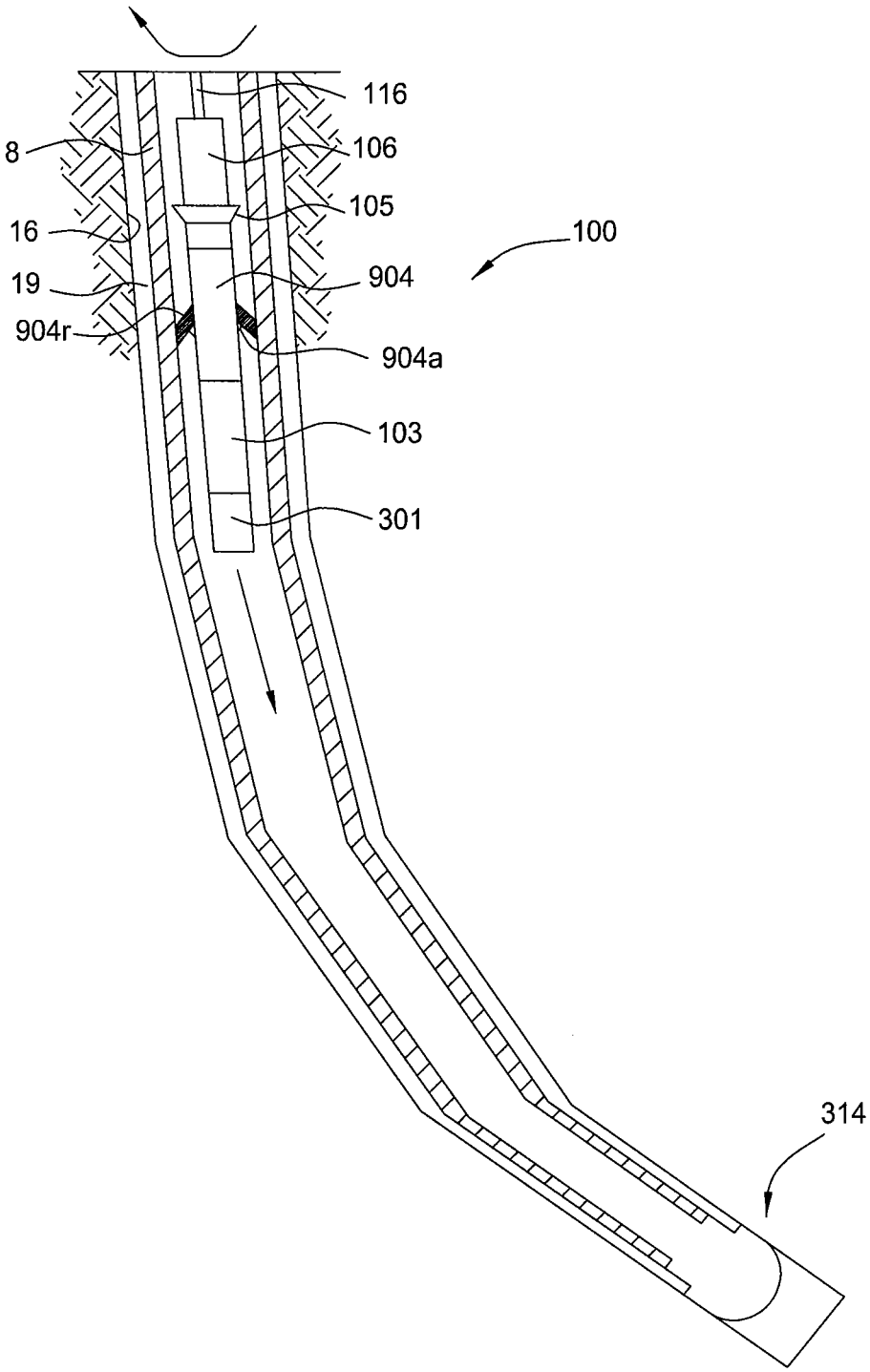
FIG. 9 illustrates a tractor deploying a BHA and connected workstring through the drillstring for conducting a logging operation through the drill bit, according to another embodiment of the present invention.

FIG. 9 illustrates a tractor 904 deploying a BHA 100 and connected workstring 116 through the drillstring 8 for conducting a logging operation through the drill bit 314, according to another embodiment of the present invention. Instead of a centralizer 104, the BHA 100 may include the tractor 904. The tractor 904 may include rollers 904*r* oriented relative to an inner surface of the drillstring 8 so that rotation of the drillstring causes the rollers to exert a longitudinal force on axles 904*a* connected to the BHA 100, thereby propelling the BHA 100 through the drillstring 8. The rollers 904*r* may be made from a slip-resistant material, such as a polymer, relative to the drillstring material (i.e., steel) and be biased against the inner surface of the drillstring 8 by a suspension (not shown), thereby frictionally connecting the rollers to the drillstring inner surface.

The suspension may account for irregularities in the inner surface and/or shape of the drillstring 8. The tractor 904 may be useful for deviated or horizontal wellbores to provide the deployment force when gravity may not be sufficient to deploy the BHA 100, such as due to frictional engagement between the BHA 100 and the drillstring 8 and/or a relatively high inclination angle of the drillstring. The BHA 100 may be rotationally restrained relative to the drillstring 8 by restraining the workstring 116 from the surface. The workstring 116 may be coiled tubing, coiled sucker rod, or jointed pipe. Additionally, the drillstring 8 may be counter-rotated to retrieve the BHA 100 to the surface. Once the nose 314*n* is released from the body 314*b*, the logging tool 103 may be inserted through the open bore 334 and the logging operation may proceed as discussed above.

Although as shown with the actuator 301 and the drill bit 314, the tractor 904 may be used to deploy any of the other actuators (i.e., actuator 401) to any of the drill bits (i.e., drill bit 414), discussed above. Alternatively, the tractor 904 may be used to deploy the mill bit 101 and mud motor 102 to the drill bit 14 or the nozzle 201 or nozzle 201 and charge 202 to the drill bit 14.

Alternatively, instead of rotating the drillstring, the BHA may include a mud motor for rotating the tractor relative to the drillstring and the drillstring may be rotationally restrained from the surface. Alternatively, the workstring may be jointed pipe and the workstring may be rotated from the surface while restraining the drillstring from the surface.

Additionally, the BHA 100 may include a video camera, fluid injection tool, completion tool, wellscreen, packer and the formation may be treated (i.e., hydraulic fracture or acid) as the drill bit is tripped from the wellbore to the surface. Additionally, the BHA 100 may include an orienter to ensure alignment of any of the actuators 301, 401 with respective drill bits 314-514.

While the foregoing is directed to embodiments of the present invention, other and further embodiments of the invention may be devised without departing from the basic scope thereof, and the scope thereof is determined by the claims that follow.

The invention claimed is:

1. A method of logging an exposed formation, comprising:
drilling a wellbore by rotating a cutting tool disposed on an adapter attached to the end of a drillstring and injecting drilling fluid through the drillstring;
deploying a BHA through the drillstring, the BHA comprising a logging tool;
forming a bore through the cutting tool;
inserting the logging tool through the bore;
longitudinally connecting the BHA to the drillstring by seating the BHA on a profile in the adapter with the logging tool extending through the bore; and
logging the exposed formation using the logging tool while tripping the drillstring into or from the wellbore.

2. The method of claim 1, wherein:
the BHA is deployed using a workstring, and
the method further comprises releasing the BHA from the workstring.

3. The method of claim 2, wherein:
the BHA comprises a bit;
the opening is formed by milling or drilling through the cutting tool using the bit.

4. The method of claim 3, wherein:
the workstring is a coiled tubing string,
the BHA further comprises a mud motor, and
the drill bit is milled or drilled through by injecting drilling fluid through the coiled tubing string, thereby operating the mud motor and rotating the bit.

5. The method of claim 3, wherein:
a nose of the cutting tool is milled or drilled through, and
the nose is made from a high strength material.

6. The method of claim 5, wherein the bit is a mill bit.

7. The method of claim 5, wherein a thickness of the nose is minimized and the bit is a drill bit.

8. The method of claim 3, wherein:
a nose of the cutting tool is drilled through, and
the nose is made from a drillable material.

9. The method of claim 2, wherein:
the workstring is a coiled tubing string,
the BHA further comprises a nozzle, and
the opening is formed by injecting an abrasive or corrosive fluid through the nozzle and impinging the fluid on the drill bit.

10. The method of claim 2, wherein:
the BHA further comprises a combustible or explosive charge, and
the opening is formed by igniting the charge and blasting or burning through the drill bit.

11. The method of claim 1, wherein:
a nose portion of the cutting tool is pre-weakened, and
the opening is formed by displacing the nose from a body of the cutting tool.

12. The method of claim 1, wherein the BHA is deployed by pumping fluid through the drillstring.

13. The method of claim 12, wherein the BHA further comprises a seal or plug engaging an inner surface of the drillstring during pumping.

14. The method of claim 1, wherein the BHA further comprises a tractor and the BHA is deployed by operation of the tractor.

15. The method of claim 14, the tractor is operated by relative rotation between the tractor and the drillstring.

16. A method of logging an exposed formation, comprising:
drilling a wellbore by rotating a cutting tool disposed on an adapter attached to the end of a drillstring and injecting drilling fluid through the drillstring;
deploying a BHA through the drillstring, the BHA comprising a logging tool;
engaging a nose of the cutting tool with the BHA;
removing the nose from a body of the cutting tool, thereby opening a bore through the cutting tool;
inserting the logging tool through the bore;
longitudinally connecting the BHA to the drillstring by seating the BHA on a profile in the adapter with the logging tool extending through the bore; and
logging the exposed formation using the logging tool.

17. The method of claim 16, wherein the bore is opened by unthreading the nose from a body of the cutting tool and extending the nose below the cutting tool.

18. The method of claim 16, wherein the bore is opened by pushing the nose from a body of the cutting tool.

19. The method of claim 16, wherein the bore is opened by pushing the nose from a body of the cutting tool and pushing the nose overcomes an interference fit.

20. The method of claim 16, wherein the bore is opened by pushing the nose from a body of the cutting tool and pushing the nose fractures one or more frangible fasteners.

21. The method of claim 16, wherein the bore is opened by melting one or more fusible fasteners.

22. The method of claim 16, wherein the bore is opened by dissolving one or more fasteners.

23. The method of claim 16, wherein the bore is opened by releasing a latch disposed in the nose.

24. The method of claim 16, wherein the bore is opened by releasing a latch disposed in the body.

25. The method of claim 16, wherein:

the nose is fastened to the BHA during engagement, and the nose is tripped out with the drillstring.

26. The method of claim 16, further comprising replacing the nose into the body after logging.

27. The method of claim 26, further comprising tripping the drill string from the wellbore after the nose is replaced.

28. The method of claim 26, further comprising drilling through a second formation after the nose is replaced and without tripping the drillstring from the wellbore.

29. The method of claim 16, wherein the BHA further comprises a tractor and the BHA is deployed by operation of the tractor.

30. The method of claim 29, the tractor is operated by relative rotation between the tractor and the drillstring.

31. A method of logging an exposed formation, comprising:

drilling a wellbore by rotating a cutting tool disposed on an adapter attached to the end of a drillstring and injecting drilling fluid through the drillstring;

operating a tractor, thereby deploying a BHA through the drillstring, wherein the BHA comprises a logging tool and the tractor;

forming or opening a bore through the cutting tool;

inserting the logging tool through the bore;

longitudinally connecting the BHA to the drillstring by seating the BHA on a profile in the adapter or the drillstring with the logging tool extending through the bore; and logging the exposed formation using the logging tool.

32. The method of claim 31, wherein the drillstring is rotated to operate the tractor.

33. The method of claim 31, wherein the BHA is deployed using a workstring.

34. The method of claim 33, wherein the BHA further comprises a mud motor and the tractor is operated by injecting fluid through the workstring and mud motor, thereby rotating the tractor.

35. The method of claim 33, wherein:

the workstring is jointed pipe, and the tractor is operated by rotating the workstring from the surface.

36. The method of claim 31, wherein the tractor is operated by relative rotation between the tractor and the drillstring.

* * * * *